US008967777B2

(12) United States Patent
Laramie et al.

(10) Patent No.: US 8,967,777 B2
(45) Date of Patent: Mar. 3, 2015

(54) LIQUID INK CONTAINERS FOR PRINTING SYSTEMS

(71) Applicant: Electronics for Imaging, Inc., Foster City, CA (US)

(72) Inventors: Steven Laramie, Laconia, NH (US); Paul Duncanson, Franklin, NH (US)

(73) Assignee: Electronics for Imaging, Inc., Menlo Park, CA (US)

( * ) Notice: Subject to any disclaimer, the term of this patent is extended or adjusted under 35 U.S.C. 154(b) by 0 days.

(21) Appl. No.: 13/692,917

(22) Filed: Dec. 3, 2012

(65) Prior Publication Data

US 2013/0088550 A1 Apr. 11, 2013

Related U.S. Application Data

(62) Division of application No. 12/424,279, filed on Apr. 15, 2009, now Pat. No. 8,322,836.

(51) Int. Cl.
*B41J 2/17* (2006.01)
*B41J 2/175* (2006.01)

(52) U.S. Cl.
CPC ..... *B41J 2/17546* (2013.01); *B41J 2/17553* (2013.01); *B41J 2/1754* (2013.01); *B41J 2/17556* (2013.01); *B41J 2/1752* (2013.01)
USPC ..... 347/86; 347/84; 347/85

(58) Field of Classification Search
None
See application file for complete search history.

(56) References Cited

U.S. PATENT DOCUMENTS

| | | | | |
|---|---|---|---|---|
| 4,353,654 | A | 10/1982 | Shiurila et al. | |
| 6,022,101 | A | 2/2000 | Sabonis | |
| 6,079,823 | A | 6/2000 | Droege | |
| 6,290,343 | B1 * | 9/2001 | Lewis et al. | 347/85 |
| 6,467,888 | B2 | 10/2002 | Wheeler et al. | |
| 7,431,437 | B2 | 10/2008 | Wilson et al. | |
| 2002/0051034 | A1 | 5/2002 | Shinada | |
| 2002/0113850 | A1 | 8/2002 | Wheeler et al. | |
| 2005/0151801 | A1 | 7/2005 | Neese et al. | |
| 2006/0164482 | A1 | 7/2006 | Katayama et al. | |
| 2013/0114539 | A1 | 5/2013 | Kim et al. | |
| 2013/0135403 | A1 | 5/2013 | Laramie et al. | |

FOREIGN PATENT DOCUMENTS

| | | |
|---|---|---|
| EP | 0674999 | 10/1995 |

* cited by examiner

*Primary Examiner* — Stephen Meier
*Assistant Examiner* — Renee I Wilson
(74) *Attorney, Agent, or Firm* — Michael A. Glenn; Perkins Coie LLP

(57) ABSTRACT

A liquid ink container having mating features for self alignment with an ink delivery station. The ink delivery station includes a receiver with an actuated puncture ring. The liquid ink container includes a cap that is punctured by the ring to allow fluid flow from the container. The receiver and container also include means for introducing pressurized gas into the container to facilitate evacuation of liquid ink.

9 Claims, 10 Drawing Sheets

LIQUID INK CONTAINERS FOR PRINTING SYSTEMS

CROSS REFERENCE TO RELATED APPLICATIONS

This application is a Divisional of U.S. application Ser. No. 12/424,279, entitled Liquid Ink Container and Delivery Station, filed 15 Apr. 2009, which is incorporated herein in its entirety by this reference thereto.

This application is also related to PCT Application No. PCT/US10/31267, entitled Liquid Ink Container and Delivery Station, filed 15 Apr. 2010, which claims the benefit of U.S. application Ser. No. 12/424,279, entitled Liquid Ink Container and Delivery Station, filed 15 Apr. 2009.

The applicants hereby rescind any disclaimer of claim scope in the parent application or the prosecution history thereof and advises the USPTO that the claims in this application may be broader than any claim in the parent application.

BACKGROUND OF THE INVENTION

1. Technical Field

The invention relates to the field of inkjet printing. More specifically, the invention relates to liquid ink delivery for large throughput printing applications.

2. Description of the Related Art

Inkjet printing involves depositing droplets of liquid ink onto a printing medium from one or more printer heads. The printer heads are coupled with a container containing ink. Ink is ejected from one or more nozzles of the print heads when a piezoelectric crystal in the print head is actuated. The piezoelectric crystal generates a pulse in the ink so that the ink expels through the nozzle as a droplet. To create the image, a carriage which holds one or more print heads scans or traverses across the printing medium, while the print heads deposit ink as the printing medium moves.

Small desktop inkjet printers are common consumer electronic products. Indeed, many consumer and business printing needs may be met by small desktop inkjet printing systems because of the relatively small amount of ink needed for common print jobs. However, some printing applications require much larger amounts of ink. For instance, large format printing is performed to create signs, banners, museum displays, sails, bus boards and the like. These types of applications require large throughput printers and require a much larger quantity of ink.

Ink cartridges are typically sold with replaceable ink reservoirs. Ink reservoirs are typically individually packaged and sold over the counter. However, common inkjet reservoirs contain far less ink than is required for large format printing. Currently, replacement reservoirs are not available in volumes greater than approximately five liters. Furthermore, the overhead cost associated with individually manufacturing, packaging and shipping small, individual replacement reservoirs is burdensome given that they must be replaced frequently to achieve large format printing.

Additionally, the ink used for inkjet printing is very expensive. This encourages designing printing systems that waste little ink. Some common containers for large format printing are designed to collapse in order to force the ink out of the cartridges and waste as little ink as possible. However, collapsible containers must be packaged in a protective shell or secondary container to protect the integrity of the container during shipping and handling. The secondary container adds to the overall cost of replacement ink.

SUMMARY OF THE INVENTION

In view of the foregoing, the invention provides a large liquid ink container and an ink delivery system for using the same.

In some embodiments of the invention, the liquid ink container is a large, substantially rigid receptacle designed for large format printing applications, wherein the receptacle does not need a secondary container to protect it during shipping. In some embodiments of the invention, the liquid ink container is substantially opaque.

In some embodiments of the invention, an ink delivery system is used to accept the large liquid ink container and designed to support the container at an angle, such that liquid ink flows from the container due to the force of gravity. In some embodiments, the ink delivery system includes protrusions disposed on the support surface. The protrusions are especially designed to mate with notches on the liquid ink container, such that the container self-aligns with the delivery system.

In some embodiments, an identification tag is disposed on the liquid ink container to provide information to a user regarding the contents therein. According to these some embodiments, the ink delivery system includes an identification tag reader, a processor, computer implemented instructions stored in a memory, and a user interface. Using these components, a user can view the content data.

In some embodiments, the ink delivery system includes a receiver configured to mate with the cap of the liquid ink container. According to these embodiments, a metal ring disposed within the receiver actuates, stamping a hole in the cap, thus initiating fluid ink flow. The self aligning features described above work synergistically with the cap puncturing means.

In some embodiments of the invention, the receiver includes a gas port and the cap includes a gas fitting. The gas port and gas fitting are aligned in fluid communication with one another when the receiver and the cap are coupled. The receiver also includes a nozzle for the introduction of forced gas. According to these embodiments, forced air traverses the receiver and the cap and is introduced into the liquid ink container. The forced gas helps facilitate evacuation of the liquid ink from the container.

In some embodiments of the invention, the ink delivery system includes a processor and computer implemented instructions stored on a memory device that automates fluid flow upon coupling the liquid ink container with the ink delivery system. The gas port, the gas fitting, the actuating metal ring, the processor and the self-aligning features offer a user-friendly ink delivery method.

BRIEF DESCRIPTION OF THE DRAWINGS

FIG. 4B-1 and FIG. 4B-2 are other perspective views of the puncture cap and the receiver, according to some embodiments of the invention;

DETAILED DESCRIPTION OF THE INVENTION

Liquid Ink Container

Figure 1A:
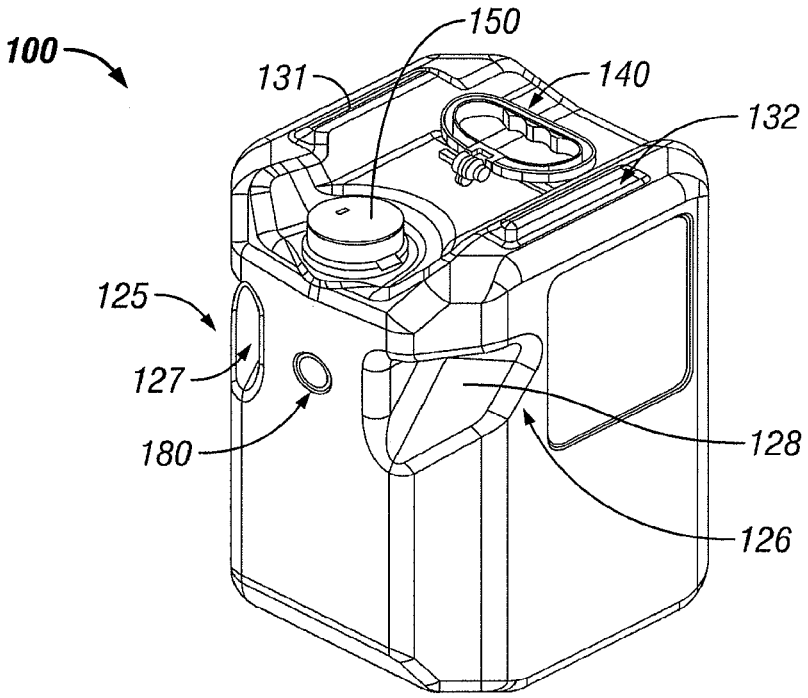
FIG. 1A is an isometric view of a liquid ink container, according to some embodiments of the invention.

FIG. 1A is an isometric view of a liquid ink container 100, according to some embodiments of the invention. The liquid ink container 100 is substantially hermetic and isolates liquid ink from atmospheric conditions such that the ink remains useable in liquid printing applications. In some embodiments of the invention, the liquid ink container 100 holds ultraviolet curable ink. According to these embodiments, the liquid ink container 100 is preferably opaque to the ultraviolet spectrum.

The liquid ink container 100 is configured with side notches 125, 126 and a cap 150. The side notches 125, 126 define angled surfaces 127, 128. In some embodiments, the liquid ink container is emptied into an ink delivery system (shown below) having a support surface and one or more support protrusions. The angled surfaces 127, 128 support the liquid ink container 100 at a downward angle when interfaced with appropriate extrusions on a support surface of an ink delivery station (explained below). When so positioned, the liquid ink container 100 empties due to the force of gravity on the ink contained therein. In some embodiments of the invention, the delivery of ink is automated and accomplished without manual interaction beyond placing the liquid ink container 100 in an inverted position within the ink delivery system.

In some embodiments, the cap 150 is designed to be punctured for allowing liquid ink to flow while the liquid ink container 100 is in the downward angle position. According to these embodiments, the cap 150 can be positioned on the very edge of the liquid ink container 100 such that when the liquid ink container 100 is emptied, ink does not pool up within the liquid ink container 100.

In some embodiments of the invention, the liquid ink container 100 is substantially rigid. In these embodiments an additional shipping container may not be needed to protect the contents.

As explained above, common ink containers found in prior art must be collapsible in order to fully evacuate the ink therein. However, using a substantially rigid material discourages a collapsing system. Therefore, according to some of these embodiments, the liquid ink container 100 is configured with a gas fitting (explained below) for introduction of pressurized gas into the liquid ink container 100 to assist in the evacuation of the liquid ink contained therein. In some embodiments, the gas fitting is disposed in the cap 150. The rigidity of the liquid ink container 100 is made possible by the disclosed method and corresponding apparatus for effective evacuation of ink from the liquid ink container 100 using forced gas (explained below).

The liquid ink container 100 also includes stacking lugs 131, 132 comprising protrusions from the top surface of the liquid ink container 100 and corresponding stacking recesses (explained below) in the bottom surface of the liquid ink container 100. Accordingly, liquid ink containers 100 can stack upon one another, thus facilitating efficient storage and shipping.

Figure 1B:
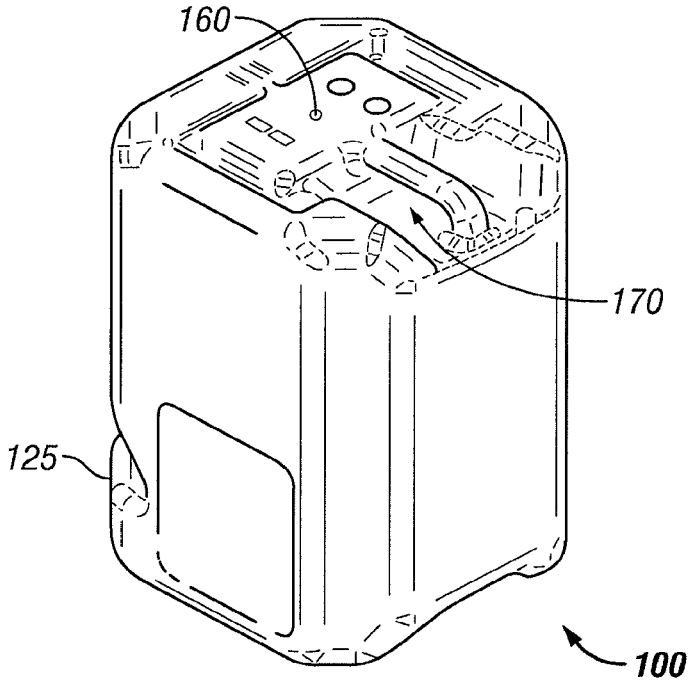
FIG. 1B is an isometric view of the liquid ink container showing the bottom surface, according to some embodiments of the invention.

In some embodiments of the invention, a swing handle 140 is coupled to the top surface of the liquid ink container 100. FIG. 1B is an isometric view of the liquid ink container 100 showing the bottom surface 160. As explained above, stacking recesses 133, 134 are disposed on the bottom surface 160. Also on the bottom surface 160 is an integral handle 170. The swing handle 140 and the integral handle 170 facilitate easy handling of the liquid ink container 100.

In some embodiments of the invention the liquid ink container 100 is especially designed for large ink volume applications, such as fast throughput printing applications. In some embodiments, the liquid ink container 100 holds approximately twenty liters of liquid ink. According to some embodiments, the liquid ink container has the approximate dimensions of sixteen and one sixth inches by nine and three quarters inches by eleven and one quarter inches.

Identification of Liquid Ink Containers

In some embodiments of the present invention, the liquid ink container 100 includes an identification tag 180. The identification tag 180 contains information relating to the contents of the liquid ink container 100. For example, in some embodiments, the identification tag 180 includes information relating to the color of ink, the date the ink was manufactured, the name of the manufacturer of the ink, the quantity of ink, the expiration date of the ink, or combinations of these data.

In some embodiments of the invention, the identification tag 180 comprises a radio frequency identification (RFID) tag. According to these embodiments, the RFID tag contains encrypted data relating to the ink contained within the liquid ink container 100. Operation of a RFID tag is described in greater detail in the commonly-assigned U.S. Pat. No. 7,431,436, which issued on Oct. 7, 2008, the entire contents of which are incorporated herein by reference.

Liquid Ink Container and Ink Delivery Station

Figure 2A:
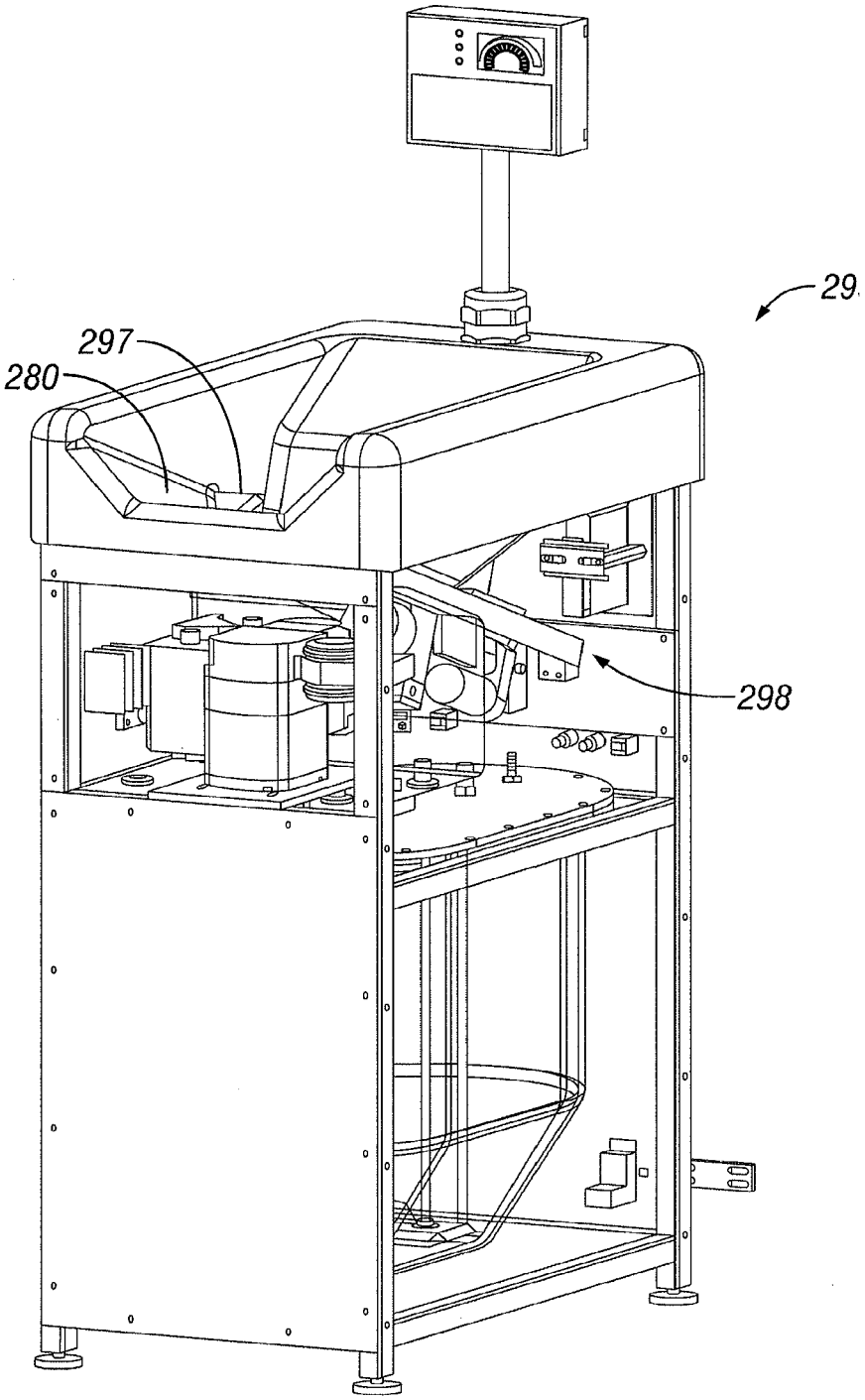
FIG. 2A is an isometric view of an ink delivery station, according to some embodiments of the invention.

In some embodiments of the invention, a liquid ink container and an ink delivery station are used together to produce synergistic results. FIG. 2A is an isometric view of an ink delivery station 299 according to some embodiments of the invention. The ink delivery station 299 includes a shelf 298 disposed at an acute angle from the horizontal plane, with a support surface 280 for supporting a liquid ink container. The shelf 298 is configured with support protrusions 297 upon which the side notches, e.g. 125, 126, and the angled surfaces, e.g. 127, 128, of a liquid ink container, e.g. 100, interact to support the liquid ink container (as explained above).

In some embodiments, the notches, e.g. 125, 126, and the support surfaces of the liquid ink container, e.g. 100, securely accommodate the support protrusions 297, thereby self-aligning the liquid ink container 100, within the ink delivery station 299. In some embodiments, the notches, the support surfaces of the liquid ink container 100 and the support protrusions 297 secure the liquid ink container 100 at an approximately twenty degree angle from the horizon while positioned in a level ink delivery station 299.

Figure 2B:
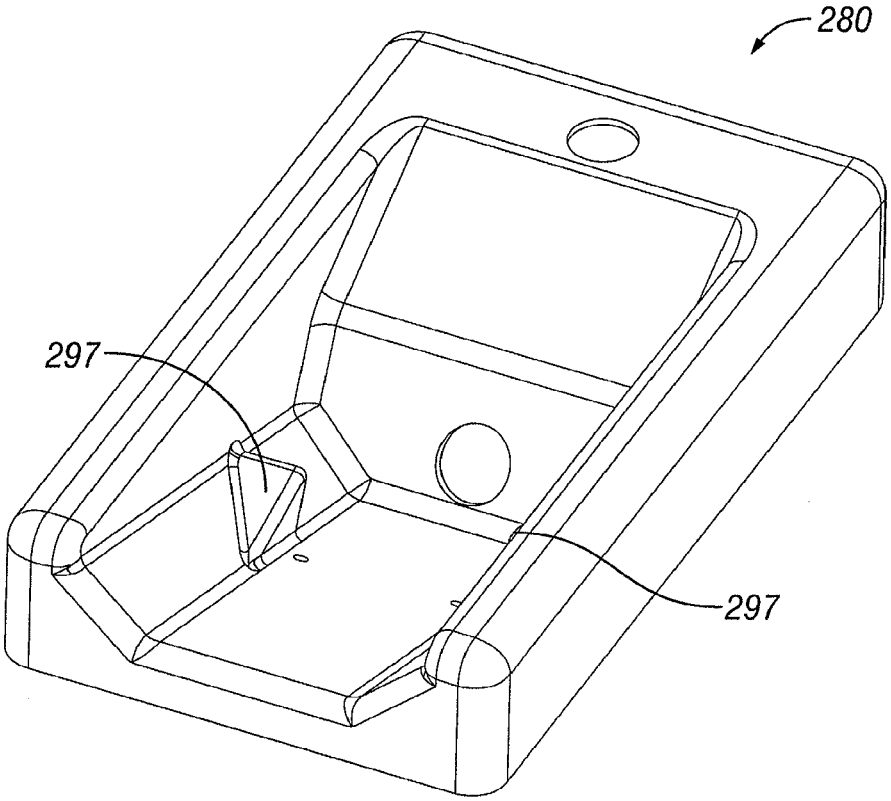
FIG. 2B is an isometric view of a support surface which couples with the shelf of an ink delivery station, according to some embodiments of the invention.
Figure 5A:
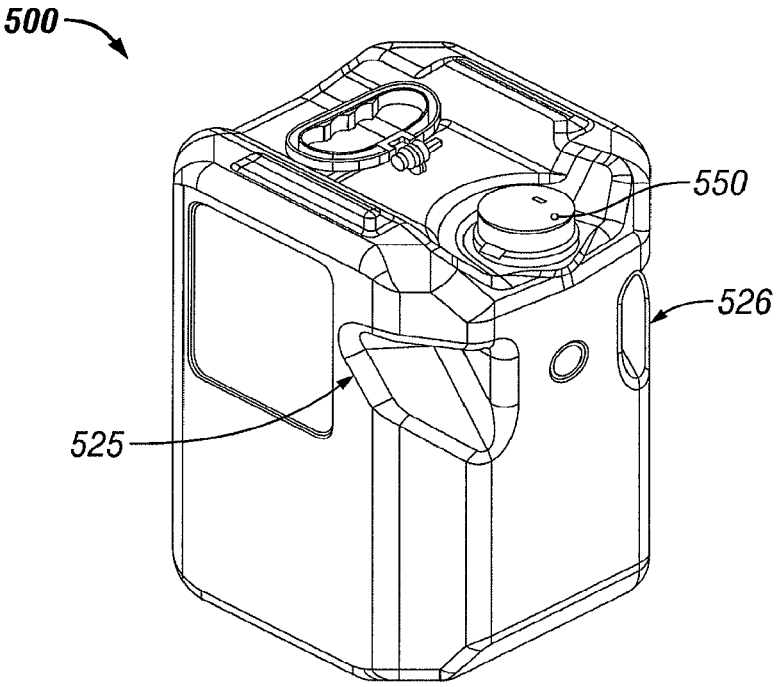
FIG. 5A and FIG. 5B are isometric views of a liquid ink container and a support surface, according to some embodiments of the invention.

FIG. 2B is an isometric view of a support surface 280 which couples with the shelf 298 of an ink delivery station 299. As explained above, the support surface 280 supports a liquid ink container, e.g. 100 (FIG. 1A, FIG. 1B), 200 (FIG. 2C), 500 (FIG. 5A). The support surface 280 includes support protrusions 297 and a conduit 296 into which the cap of a liquid ink container, e.g. 100, 200, 500, partially extends.

Figure 2C:
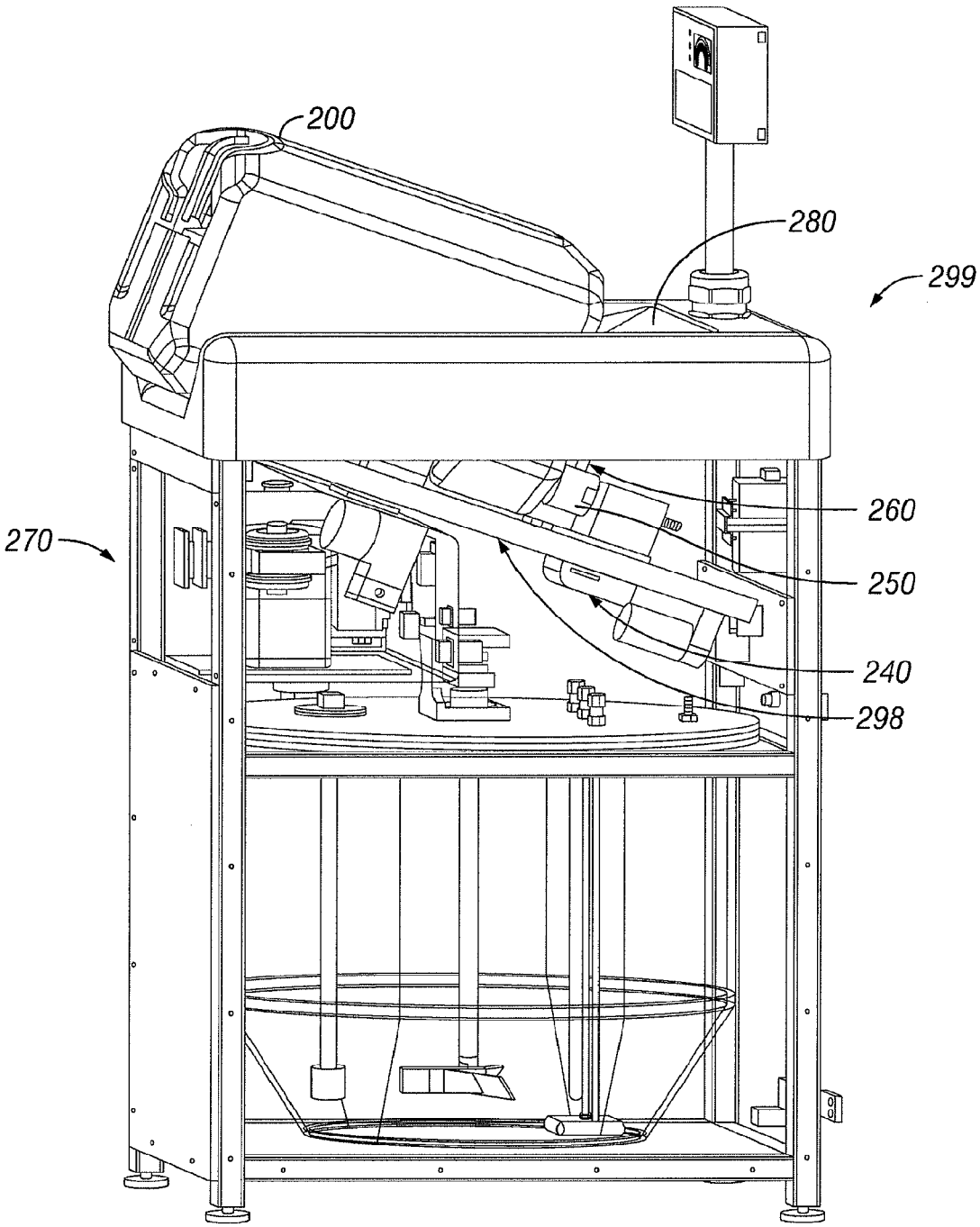
FIG. 2C is an isometric view of a liquid ink container coupled with an ink delivery station, according to some embodiments of the invention.

FIG. 2C is an isometric view of a liquid ink container 200 coupled with an ink delivery station 299 according to some embodiments of the invention. The ink delivery station 299 includes a shelf 298 and a support surface 280 as explained above. The ink delivery station 299 also includes a receiver 250 and ink delivery lines 240.

The receiver 250 allows liquid ink to flow therethrough. In some embodiments of the invention, the receiver 250 punctures the cap 150 of the liquid ink container 200, allowing the flow of liquid ink. In some embodiments of the invention, the receiver 250 contains a ring (FIG. 3B) for puncturing the cap 150 of the liquid ink container 200.

In some embodiments, the receiver 250 is configured with a nozzle 260 for the introduction of pressurized gas. In some embodiments of the invention, the cap of the liquid ink container 200 is configured with a gas port (shown below) to facilitate the introduction of pressurized gas from the receiver into the liquid ink container 200, for assisting the evacuation of the ink contained therein.

The liquid ink delivery system 299 also includes ink delivery lines 240 that couple with a printing station (not shown). In some embodiments of the invention, the liquid ink delivery system 299 couples with a dedicated printing station. In other embodiments, the liquid ink delivery station 299 is modular and compatible with wide variety of printing stations.

Figure 2D:
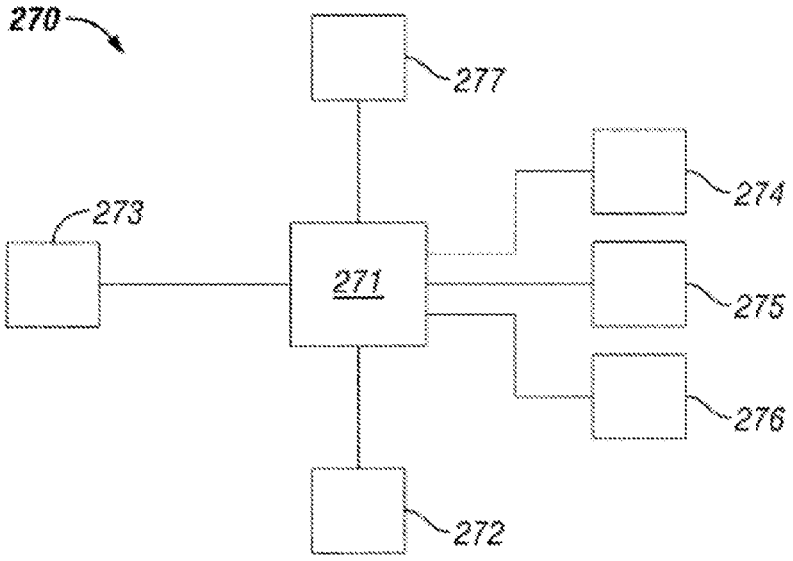
FIG. 2D illustrates a schematic of the processing unit and user interface, according to some embodiments of the invention.

In some embodiments of the invention, the ink delivery station 299 also includes a processing unit 270 and a user interface 279. FIG. 2D illustrates a schematic of the processing unit 270 and user interface 275, according to some embodiments of the invention. The processing unit 270 comprises a processor 271, a memory 272 containing machine readable instructions, a user input 273, a RFID reader 277, and outputs 274, 275, and 276. In some embodiments of the invention, the user input 273 comprises a button for initiating the automated ink delivery process disclosed below.

In some embodiments, output 274 comprises a metal ring actuator and output 275 comprises a nozzle actuator. In some other embodiments, the outputs 274, 275 and/or 276 comprise a pump for the introduction of forced air or an ink pump to deliver ink to the print station. According to these embodiments, the processing unit 270 can initiate the flow of liquid ink from the liquid ink container. In some embodiments, output 276 is the user interface 279.

In some embodiments, the RFID reader 277 is positioned within the processing unit 270 of the ink delivery system 299, such that it can read an RFID tag on the liquid ink container 200. According to these embodiments, the processor 271 interprets information obtained from the RFID reader 277, and displays it on the user interface 279.

Figure 2E:
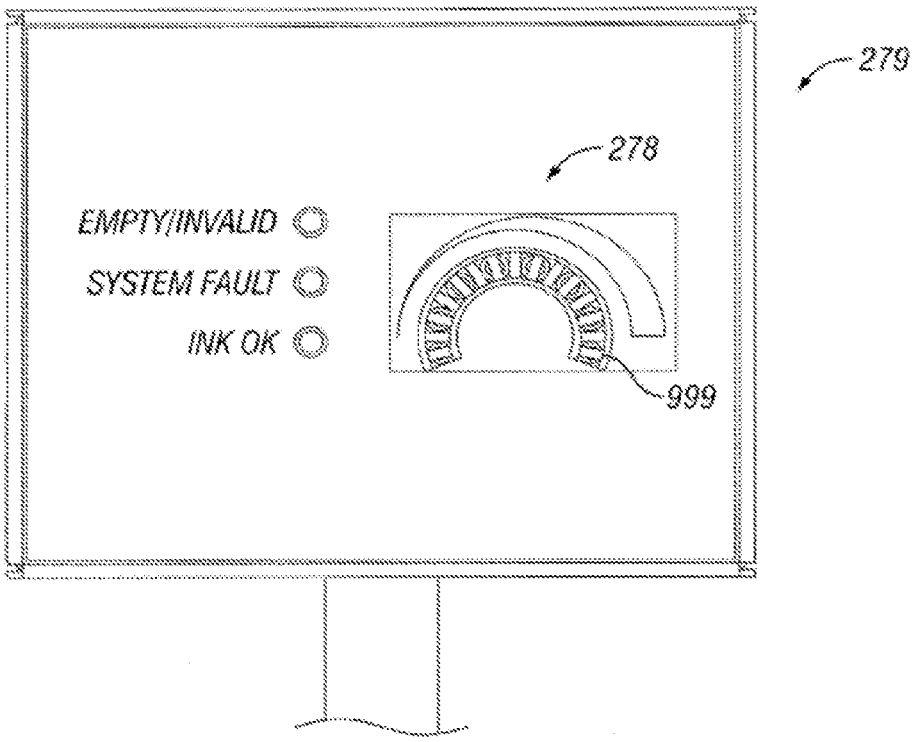
FIG. 2E illustrates a schematic of a user interface with an ink level display having a bank of indicators according to some embodiments of the invention.

In some embodiments, additional inputs are used for displaying additional information on the user interface 279. FIG. 2E illustrates a schematic of a user interface 279 with an ink level display 278 having a bank of indicators 999 according to some embodiments of the invention. In some embodiments, the bank of indicators 999 comprises a plurality of light-emitting diodes (LED).

The ink level display 278 communicates with, and is responsive to a float mechanism contained within the liquid ink container 200. In some embodiments, the float mechanism has a discrete number of incremental sensors for determining the ink level at various different points in the vertical dimension inside the liquid ink container 200. The float mechanism sends a signal through the processor 271, and to the ink level display 278 on the user interface 279, which lights up one or more indicators from the bank of indicators 999. In some embodiments, one or more of the indicators within the bank of indicators 999 are colored differently from one or more other indicators.

Puncture Cap, Receiver, and Puncturing Ring

Figure 3A:
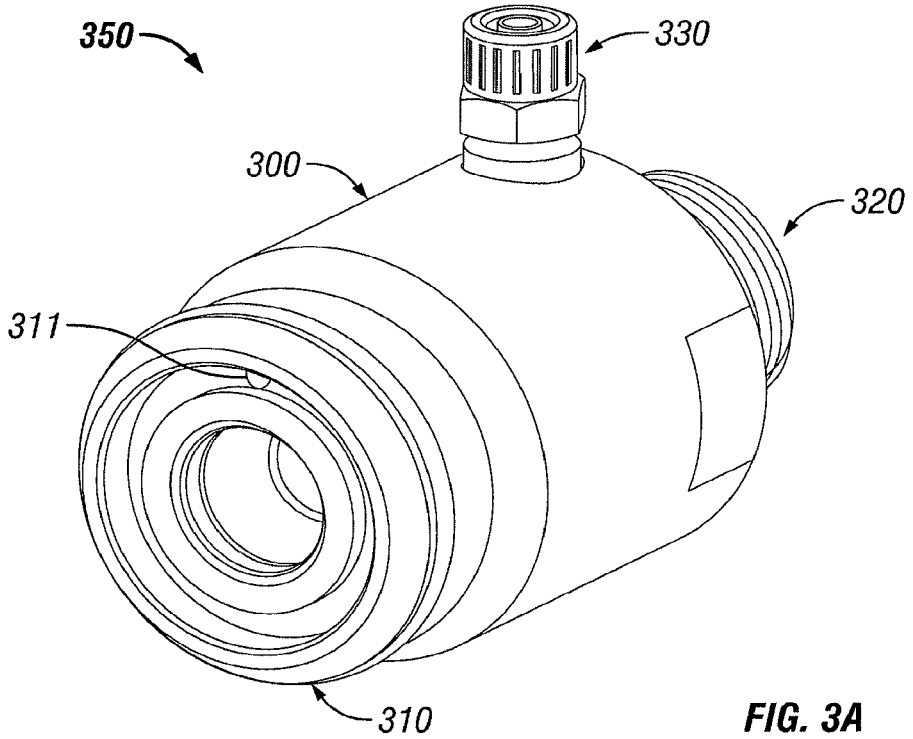
FIG. 3A is an isometric view of a receiver according to some embodiments of the invention.

FIG. 3A is an isometric view of a receiver 350, according to some embodiments of the invention. The receiver 350 comprises a substantially cylindrical body 300, a nozzle 330 for introduction of forced gas, a first terminal end 310 for coupling with a puncture cap, and a second terminal end 320 for coupling with ink delivery lines. The body 300 is substantially hollow to facilitate fluid flow through the receiver 350. Included in the first terminal end 310 is a pressurized gas port 311 for delivering pressurized gas from the receiver 350 through the puncture cap to the liquid ink container.

Figure 3B:
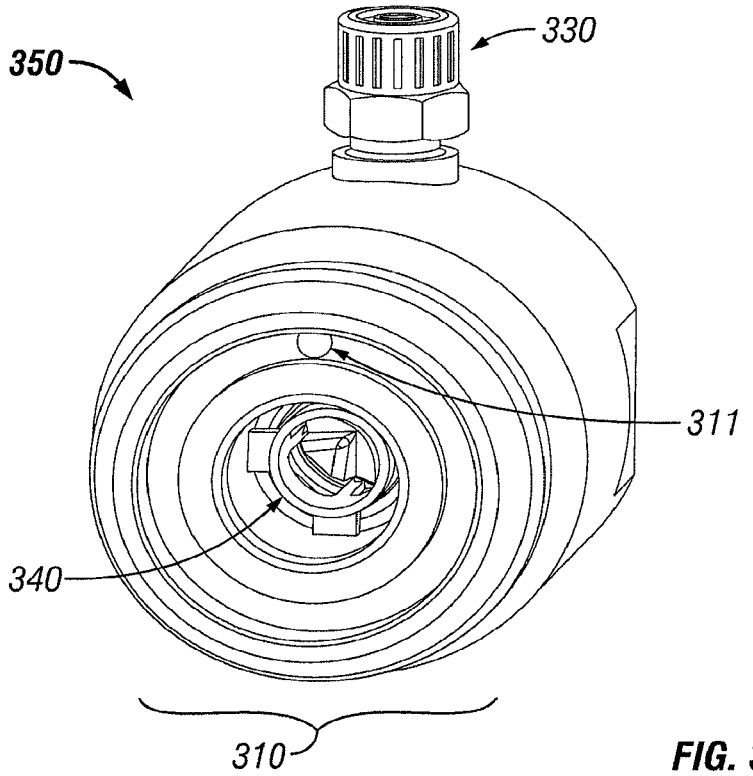
FIG. 3B is another isometric view of the receiver, according to some embodiments of the invention.

FIG. 3B is another isometric view of the receiver 350, according to some embodiments of the invention. FIG. 3B details the first terminal end 310 of the receiver 350 and the pressurized gas port 311. Within the cylindrical body 300 is a metal ring 340. The metal ring 340 is actuated such that the metal ring 340 extends through the first terminal end 310 of the receiver 350, for stamping a hole through the puncture cap, thus allowing liquid ink flow from the liquid ink container through the receiver 350.

In some embodiments of the invention, the metal ring 340 is actuated by an electric actuator (not shown) coupled to the receiver 350. Although electric actuation is explicitly disclosed, it will be readily apparent to those with ordinary skill in the relevant art having the benefit of this disclosure that a wide variety of other actuation devices (e.g. pneumatic actuation) are similarly applicable for actuating the metal ring 340.

Forced Gas Evacuation

As explained above, it is common to use small, collapsible ink containers in printing applications. To ensure that little ink is wasted, the small ink containers are collapsed to consolidate ink in the gradually smaller volume of the container. This method is generally acceptable in small liquid ink container applications.

However, in high throughput printing applications, it is desirable to use large volume, substantially rigid liquid ink containers. Large volume containers provide more ink, thereby reducing the frequency of changing containers. Rigidity is desirable because it enables the containers to be shipped without additional packaging. However, substantially rigid liquid ink containers are not easily collapsible. Therefore, it would be desirable to ensure substantial evacuation of liquid from large, substantially rigid liquid ink containers, thereby limiting wasted ink. According to some embodiments of the invention, the liquid ink container is set at an angle, to facilitate gravity induced fluid flow. Additionally, gas is forced into the container, to further force the liquid ink out of the container, by the additional force of the gas on the remaining ink.

Cap Puncture and Introduction of Forced Gas

Figures 1, 4A:
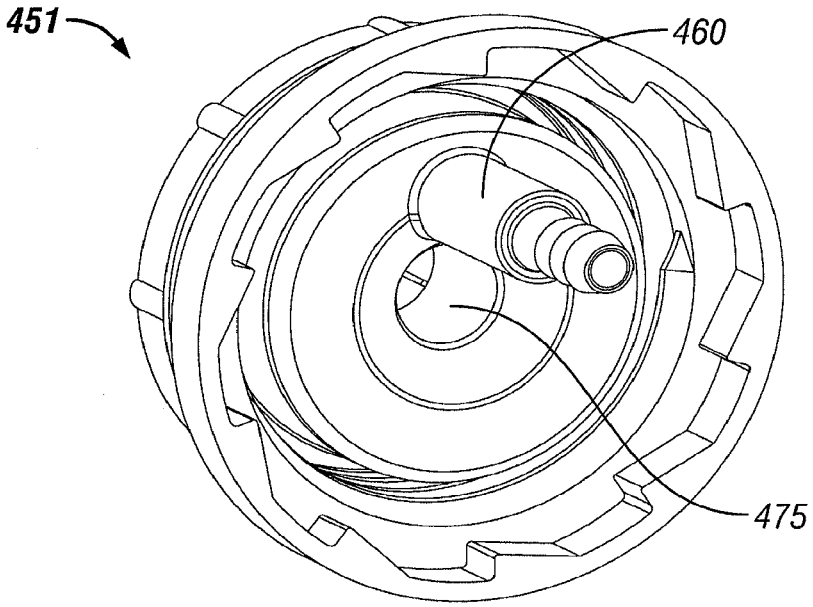
FIG. 4A-1 and FIG. 4A-2 are isometric views of a puncture cap and a receiver, according to some embodiments of the invention.

FIG. 4A-1 and FIG. 4A-1 are isometric views of a puncture cap 451 and a receiver 450. The puncture cap 451 couples with the liquid ink container, e.g. 100, as shown in FIG. 1A.

When the liquid ink container 100 is coupled with the liquid ink delivery station 299, the puncture cap 451 couples with receiver 450. When coupled, forced gas from the receiver 450 traverses through the puncture cap 451 and into the liquid ink container 100 (not shown).

Forced gas is introduced to the receiver 450 through a nozzle 430. The forced air traverses the body 400 via an internal conduit (not shown), and exits the receiver 450 via the pressurized gas port 411. When coupled, the pressurized gas port 411 aligns with a gas fitting 460 coupled to the puncture cap 451. In some embodiments, the gas fitting 460 contains a check valve (not shown) to allow gas to flow into the liquid ink container, e.g. 100, but to prevent gas from flowing out of the liquid ink container 100 through the gas fitting 460.

The puncture cap 451 is configured with a substantially hermetic conduit 475. The conduit 475 is open on the inner side of the puncture cap 451 and sealed on the outer side of the puncture cap 451. As explained above, the receiver 450 contains a metal ring 440 that is actuated. When the puncture cap 451 and the receiver 450 are coupled, the metal ring 440 aligns with the conduit 475. When the metal ring 440 is actuated, it extends through the first terminal end 410, into the conduit 475 of the puncture cap 451, and stamps a hole in the sealed end of the conduit 475. After actuation, liquid ink can freely flow from the liquid ink container, e.g. 100, through the puncture cap 451, through the receiver 450 and into delivery lines 240 (not shown).

Figures 2, 4A:
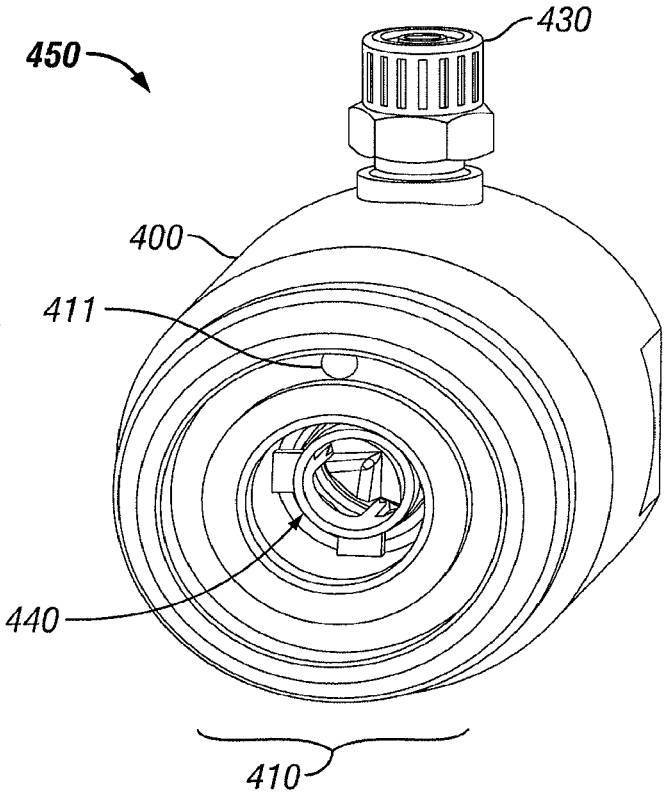
Figures 1, 4B:
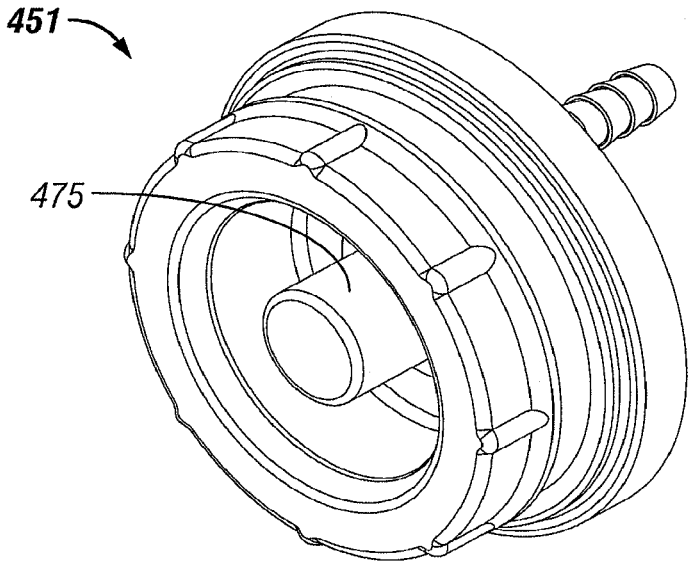
Figures 2, 4B:
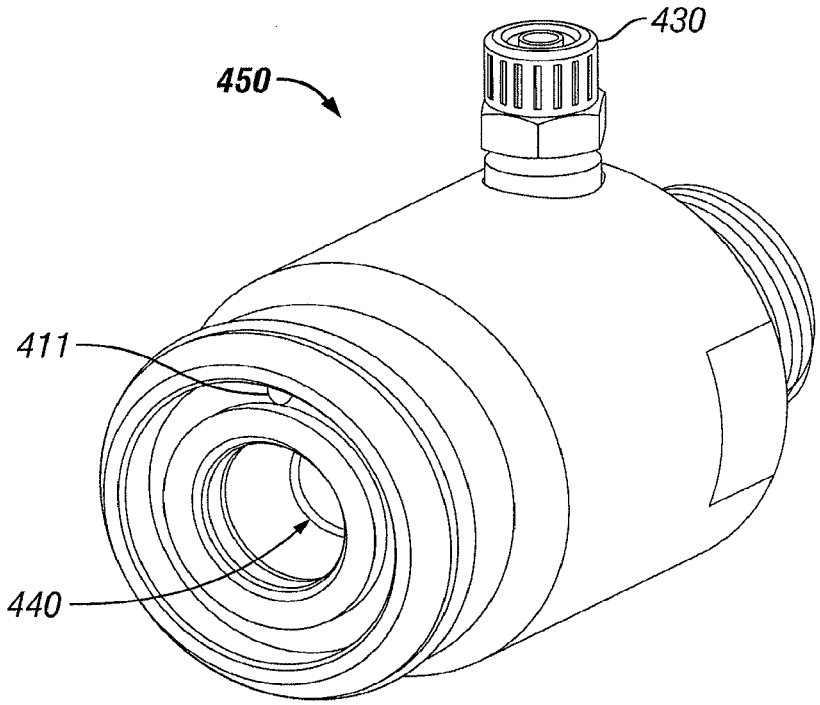

FIG. 4B-1 and FIG. 4B-2 are other perspective views of the puncture cap 451 and the receiver 450. The puncture cap 451 is shown with the previously sealed end of the conduit stamped out by the metal ring 440. Furthermore, the gas fitting 460 is in fluid communication with the conduit 475.

As such, when the puncture cap 451 and the receiver 450 are coupled, forced gas from the nozzle 430 traverses the receiver 450 via an internal conduit (not shown), passes through the pressurized gas port 411, enters the gas fitting 460 and flows into the conduit 475. When the puncture cap 451 is coupled with a liquid ink container, e.g. 100, forced gas enters the liquid ink container 100 via the conduit 475, and helps evacuate liquid ink from the liquid ink container 100.

Mating Features and Self-Alignment

In some embodiments of the invention, a liquid ink delivery station 299 and a liquid ink container, e.g. 100, are designed with mating features for self-alignment. In the forced air evacuation systems, such as those described in FIGS. 4A-1, 4A-2, 4B-1, and 4B-2 above, the receiver 450 and the puncture cap 451 should be carefully aligned to facilitate proper puncturing, and proper alignment of the pressurized gas port 411 and the gas fitting 460. These systems will benefit further by using mating features for self-alignment.

Referring again to FIG. 2A, the ink delivery station 299 includes a shelf 298 with a support surface 280 for holding a liquid ink container, e.g. 100, 200 (not shown). The shelf 298 and the support surface 280 are disposed at an angle to facilitate fluid flow due to the force of gravity. The shelf 280 includes support extrusions 297.

Figure 5B:
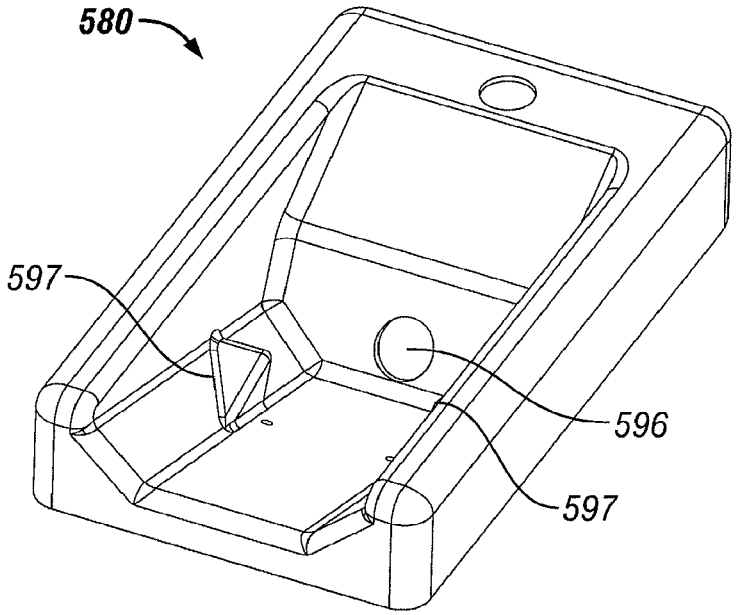

FIG. 5A and FIG. 5B are isometric views of a liquid ink container 500 and a support surface 580 which couples with the shelf 298 of an ink delivery station 299. As explained above, the support surface 580 supports the liquid ink container 500. The liquid ink container 500 includes side notches 525, 526 and a puncture cap 550. Likewise, the support surface 580 includes support protrusions 597 and a conduit 596. The side notches 525, 526 and the support protrusions 597 mate upon placing the liquid ink container 500 in the support surface 580.

Likewise, the puncture cap 550 mates with, and partially extends into, the conduit 596. According to these embodiments, only a liquid ink container 500 with appropriate sized side notches 525, 526 will couple with the support surface 580. Additionally, according to these embodiments, a force exerted to the puncture cap 550 will prevent the liquid ink container 500 from becoming decoupled from the support surface 580.

As explained above, liquid ink containers using forced gas evacuation systems will benefit from the mating and self-alignment features. Particularly, self-alignment offers ease of user operation. The user simply places the liquid ink container 500 into the support surface 580 in order to ensure proper alignment of the puncture cap 550. Accordingly, the user need not worry about further aligning the actuating metal ring 340, 440 of the receiver, e.g. 250, 350, 450 and the puncture cap 550, or aligning the pressurized gas port, e.g. 311 (FIG. 3A, FIG. 3B), 411 (FIG. 4A-2, FIG. 4B-2) and the gas fitting 460 (FIG. 4A-1).

Methods for Liquid Ink Delivery

Figure 6:
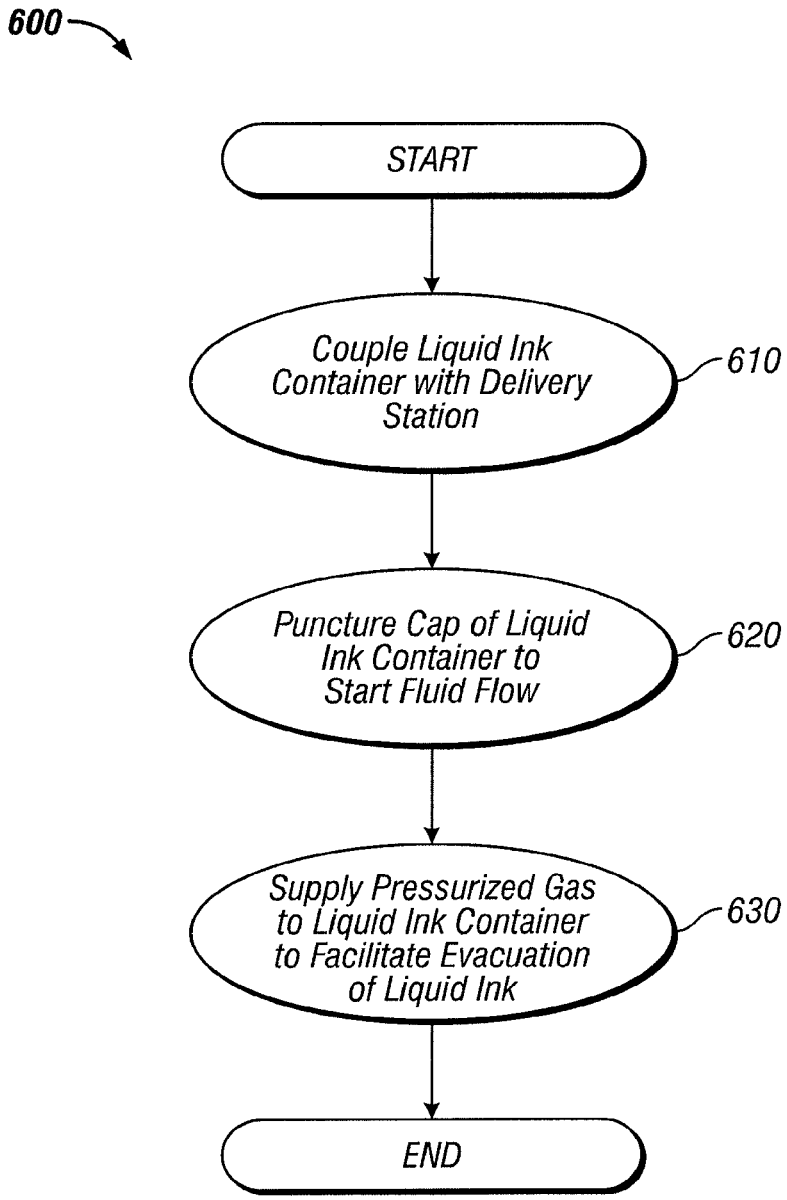
FIG. 6 illustrates the process steps of a method of using a large, substantially rigid liquid ink container in a large throughput printing system, according to some embodiments of the invention.

FIG. 6 illustrates a method 600 for delivering liquid ink for large throughout printing applications, using a liquid ink delivery station 299 and large liquid ink containers, e.g. 100, 200, 500. The method 600 begins with coupling a liquid ink container 100, 200, 500 with the liquid ink delivery station 299 at step 610. In some embodiments, the liquid ink container 100, 200, 500 and the liquid ink delivery station 299 include mating features, self-alignment features, or both. The method continues with puncturing the puncture cap, e.g. 451, 550, of the liquid ink container 100, 200, 500 to start fluid ink flow at step 620. Next, after fluid flow begins upon puncturing the puncture cap 451, 550, pressurized gas is introduced to the liquid ink 100, 200, 500 container at step 630. The pressurized gas assists to evacuate the liquid ink container 100, 200, 500 and to deliver the ink to the printing system.

In some embodiments of the invention, the delivery station 299 includes a computer processor, e.g. 271 (FIG. 2D), for automating one or more steps in effectuating liquid ink delivery. In some embodiments, the processor 271 is electromechanically coupled with the actuator 274 within the receiver, e.g. 250, 350, 450, and with the means for introducing pressurized gas into the receiver 250, 350, 450. According to these embodiments, a user interface 279 is provided on the liquid ink delivery station 299.

In some embodiments, the liquid ink container, e.g. 100, 200, 500, and liquid ink delivery station 299 include mating features, and the method for delivering liquid ink 600 is automated. According to these embodiments, a user effects step 610 by manually placing a liquid ink container 100, 200, 500 into the liquid ink delivery station 299. Next, the user interfaces with the delivery station 299 via a user interface 279. The remainder of the method 600 is automated by the processor 271, the electromechanically coupled actuator 274, and means for introducing pressurized gas into the receiver 250, 350, 450.

As will be understood by those familiar with the art, the invention may be embodied in other specific forms without departing from the spirit or essential characteristics thereof. Likewise, the particular naming and division of the members, features, attributes, and other aspects are not mandatory or significant, and the mechanisms that implement the invention or its features may have different names, divisions and/or formats. Accordingly, the disclosure of the invention is intended to be illustrative, but not limiting, of the scope of the invention, which is set forth in the following Claims.

The invention claimed is:

1. A liquid ink container for connection to a liquid delivery station comprising a support surface having one or more protrusions extending therefrom, wherein the liquid ink container comprises:

a receptacle having an inner volume defined therein for holding liquid ink, wherein the receptacle comprises:

a bottom surface;

a top surface opposite the bottom surface;

wherein a hole is disposed through the top surface;

at least one wall extending from the bottom surface to the top surface;

wherein the at least one wall comprises one or more inwardly extending notches;

one or more stacking lugs that extend outward from the top surface; and corresponding one or more stacking recesses that extend inward from the bottom surface;

wherein the stacking lugs from a first liquid ink container are configured to fit within the corresponding stacking recesses of a second liquid ink container when the second liquid ink container is stacked on the first liquid ink container;

a cap coupled to the receptacle for sealing the hole, wherein the cap comprises a puncture seal, and a gas fitting that is configured to introduce pressurized gas into the receptacle to evacuate the liquid ink container to deliver ink to a printing system;

wherein each of the at notches is configured to couple with a corresponding one of the protrusions, to prevent movement of the receptacle when a force is exerted on the cap.

2. The liquid ink container of claim 1, wherein the bottom surface is substantially rectangular, wherein the top surface is substantially rectangular, and wherein the at least one wall comprises four walls.

3. The liquid ink container of claim 1, further comprising: a swing handle disposed on the top surface.

4. The liquid ink container of claim 1, further comprising: an integral handle disposed on the bottom surface.

5. The liquid ink container of claim 1, further comprising: an identification mechanism coupled to the receptacle, wherein the identification mechanism comprises information relating to the contents of the liquid ink container.

6. The liquid ink container of claim 5, wherein the identification mechanism comprises a radio frequency identification chip containing data thereon.

7. The liquid ink container of claim 1, wherein the receptacle is configured to hold twenty liters of liquid ink.

8. The liquid ink container of claim 1, wherein the liquid ink comprises ultraviolet curable ink, and wherein the receptacle comprises a material that is opaque to ultraviolet light.

9. The liquid ink container of claim 1, wherein the receptacle and the cap form a substantially hermetic enclosure for the liquid ink.

* * * * *